United States Patent [19]

Faber et al.

[11] Patent Number: 4,925,355

[45] Date of Patent: May 15, 1990

[54] APPARATUS FOR BINDING A STACK OF SHEETS ALONG ONE PERIPHERAL SIDE

[75] Inventors: Pals G. Faber, Venlo; Stefanus P. E. A. Hermans, Steyl; Gert Vegter, Baarlo, all of Netherlands

[73] Assignee: Oce-Nederland B.V., Venlo, Netherlands

[21] Appl. No.: 277,856

[22] Filed: Nov. 30, 1988

[30] Foreign Application Priority Data

Dec. 7, 1987 [NL] Netherlands ..... 8702938

[51] Int. Cl.[5] ..... B42C 13/00

[52] U.S. Cl. ..... 412/37; 412/11; 412/16; 83/408; 83/869

[58] Field of Search ..... 412/16, 33, 37, 11; 83/862, 869, 42, 408, 171

[56] References Cited

U.S. PATENT DOCUMENTS

| | | | |
|---|---|---|---|
| 3,816,866 | 6/1974 | Miaskoff et al. | 412/11 X |
| 3,863,596 | 2/1975 | Anderson | 412/11 X |
| 3,902,646 | 9/1975 | Kuhns | 412/37 |
| 3,920,501 | 11/1975 | Carlton et al. | 412/16 X |
| 3,928,119 | 12/1975 | Sarring | 412/37 X |
| 4,678,386 | 7/1987 | Wiholm | 412/11 X |
| 4,797,048 | 1/1989 | Doery | 412/11 |

*Primary Examiner*—Frank T. Yost
*Assistant Examiner*—Y. Lin
*Attorney, Agent, or Firm*—Reed Smith Shaw & McClay

[57] ABSTRACT

Apparatus for binding a stack of sheets along one peripheral side by means of a strip of binder material having a heat activated layer of glue wherein removal device is provided for at least partial removal of the layer of glue in the zones of the web of binder material which, after cutting off a strip of a required length, are situated at the ends of the strip of binder material.

5 Claims, 2 Drawing Sheets

APPARATUS FOR BINDING A STACK OF SHEETS ALONG ONE PERIPHERAL SIDE

FIELD OF THE INVENTION

This invention relates to an apparatus for binding a stack of sheets along one peripheral side by means of a strip of binder material having a heat activated layer of glue.

BACKGROUND OF THE INVENTION

Apparatus for binding book or sheets are generally well known; for example, see British Pat. Specification 1 446 115 and U.S. Pat. Nos. 3,920,501 and 3,902,646. In 3,902,646 an apparatus is disclosed in which a strip of binder material provided with a heat activated layer of glue is cut off to the size of the peripheral side of a stack of sheets to be bound. After the strip of binder material has been placed against the peripheral side of the stack of sheets to be bound, it is folded about the stack of sheets by heated folding plates. The layer of glue softens under these conditions, and the glue adheres to the individual sheets. After cooling, a set of sheets in book form is obtained, the set being covered by a binder strip at the spine.

The disadvantage of a binder apparatus of this kind is that some of the softened glue flows out at the ends of the strip of binder material due to the pressure exerted by the folding plates. This escaping glue soils both the folding plates and the bound stack of sheets. The soiling on the folding plates may contaminate not only the binder apparatus itself, but may also be deposited on the next stack of sheets that will be bond.

Accordingly it is an object of the invention to provide apparatus that overcomes the foregoing disadvantages.

SUMMARY OF THE INVENTION

Generally, the present invention provides apparatus of the known type with a selectively activated removal means for at least partially removing the layer of glue in a zone over the complete width of the binder material. Also, a control means is provided for temporarily activating the removal means with an interval related to the required length of the strip of binder material.

As a result of the present invention, the ends of a strip of binder material fed to binder station are substantially free of glue so that when strip of binder material is applied about a stack of sheets no glue can escape at the ends of the strip of binder material. In one embodiment of the apparatus according to the invention, the means for at least partial removal of the layer of glue consists of a scraper.

To improve the scraper action, the scraper or the strip of binder material near the sczraper, or both, may be heated. As a result the glue to be removed is softened so that scraping can be performed more rapidly.

In another embodiment of the apparatus, the removal means are disposed in line with the cutting device transversely of the direction of conveyance of the binder material so that the line along which the binder material is cut falls within the zone in which the layer of glue is at least partially removed.

The additional advantage of this embodiment is, that first the layer of glue is removed and, directly thereafter, the binder material is cut off in the zone free from glue so that the cutting device is not subjected to extra loading by the layer of glue and cannot be soiled by the glue.

Other advantages of the invention will become apparent from a perusal of a detailed description of the presently preferred embodiments of the invention taken in connection with the accompanying drawings.

PRESENTLY PREFERRED EMBODIMENT

Figure 1:
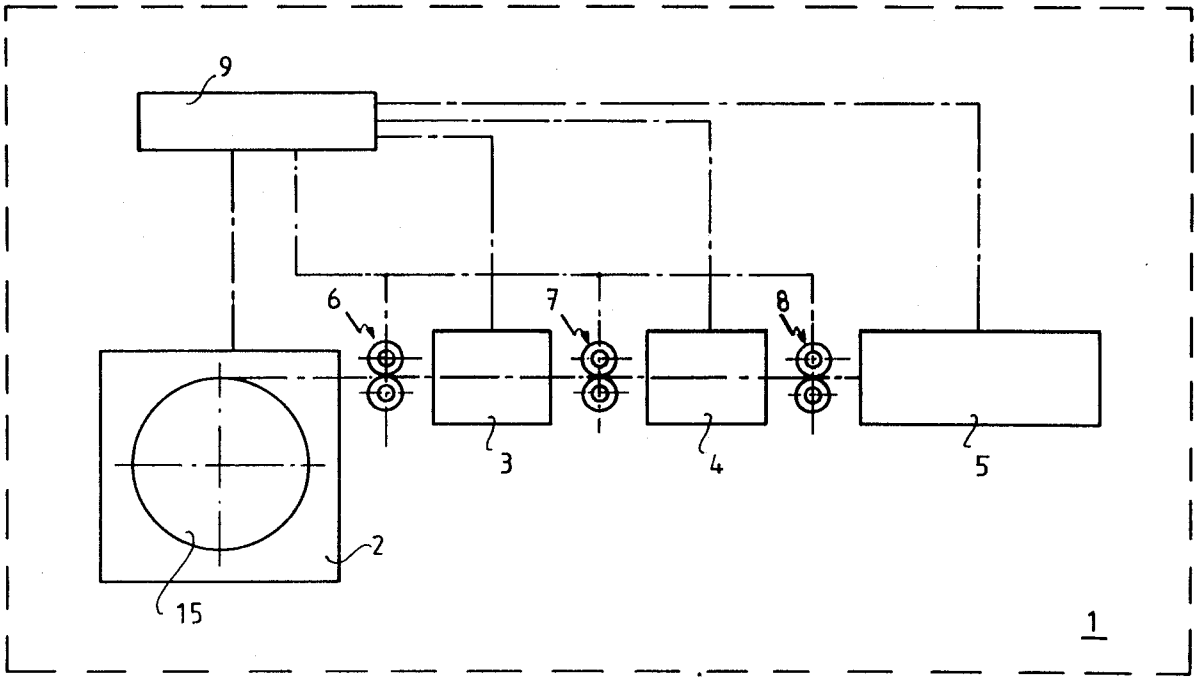
FIG. 1 is a diagram illustrating an apparatus for binding a stack of sheets.

Referring to FIG. 1, the processing stations making up apparatus 1 are shown for binding a stack of sheets to form a book. Apparatus 1 includes supply station 2, removal station 3, cutting station 4 and binder station 5. Binding apparatus 1 also includes conveyor means, such as roller pairs 6, 7 and 8, and control device 9 to control processing stations 2, 3, 4, 5 and the conveyor means.

Supply station 2 contains reel of binder material 15 rotatable by drive means (not shown) so that binder material is fed to the pair of conveyor rollers 6 and then through the other processing stations 3, 4 and 5.

Supply station 2 is, for example, constructed as a cassette system, a system which is extremely suitable for rapid changeover to a different type or quality, a different color or a different width of binder material, simply by changing the cassette. The type of binder material mainly used in the apparatus according to the invention consists of a support of paper or fabric material with a heat activated glue applied thereto. Alternatively, a binder material can be used in which three parallel strips of glue side by side are applied to the support. In this case the central strip of glue will be of the heat activated type while the outer strips will consist of a glue activated by mechanical pressure. The central glue strip finally comes into contact with the spine of the stack of sheets for binding and must therefore have a high adhesive force. The outer glue strips are stuck to the front and back pages respectively in the binder station, and the adhesive force requirements in this case are much lower.

When a stack of sheets for birding has reached binder station 5, detection means (not shown ) determine the length of the peripheral side along which the sheets are to be bound. The detection means output signals are fed to control device 9, which converts this information in a known manner to control signals for the processing stations 2, 3, 4, 5 and the conveyor means 6, 7 and 8. A known control device can be used for this purpose, which determines the times at which the processing stations 2, 3, 4, 5 and the conveyor means 6, 7 and 8 are to be activated or deactivated, such determination being effected, for example, by means of control pulses derived from a pulse disc coupled to one of the conveyor means 6, 7 and 8. The starting position for the control device when new reel of binder material is inserted can be derived, for example, from a detector which detects when the leading edge of the web of binder material reaches the nip between the conveyor rollers 6.

The drive for the supply station 2 is activated to feed binder material from the supply reel 15. The start of a new reel of binder material is conveyed by the conveyor rollers 6 to the removal station 3, in which the layer of glue is at least partially removed from the end of the binder material.

The web of binder material is then conveyed by the conveyor rollers 6, 7 and 8 through the removal station 3 until the line along which the binder material is subsequently to be cut to size in the cutting station 4 is located at the removal station 3. Conveyance of the binder material is then stopped in order to carry out the removal process. The layer of glue is at least partially removed around the cutting line in a zone of strip shape, transversely to the direction of conveyance, as will be described hereinafter in detail. After the removal operation, conveyance of the binder material is restarted so that the binder material is convered through cutting station 4 in order to be cut to the required length therein. The strip of binder material cut off is then conveyed further to binder station 5. In binder station 5, the strip of binder material is folded about the spine of the stack of sheets there by means of heated folding plates. The layer of glue of the strip of binder material softens in these conditions so that the glue adheres to the individual sheets, so that after coloring a strong bond has been formed between the strip of birder material and the spine of the stack of sheets. A set of sheets in the form of a book is thus formed and is covered with a binder strip at the spine.

According to the invention removal station 3 is provided and is essential because it prevents the softened glue from flowing out at the ends of the strip of binder material under the influence of the contact-pressure force of the folding plates in the binder station 5. Escaping glue will soil both the stack of sheets and the folding plates themselves. This soiling is undesirable both in respect of the product of the binder apparatus 1 and the folding plates. In addition, the location of removal station 3 in front of the cutting operation in cutting station 4 has the additional advantage that the cutting parts of cutting station 4 are subjected to less load and less soiling by glue residues.

Although the following description of removal station 3 describes only the embodiment with the layer of glue largely being scraped away in &he zone around the cutting line, the invention is in ro way restricted thereto.

Other embodiments for the removal of the layer of glue at the ends of the strip of binder material which give the same result are, for example, removal of the layer of glue by a suitable solvent or contacting the layer of glue with a material which alsorbs the softened glue.

Figure 2:
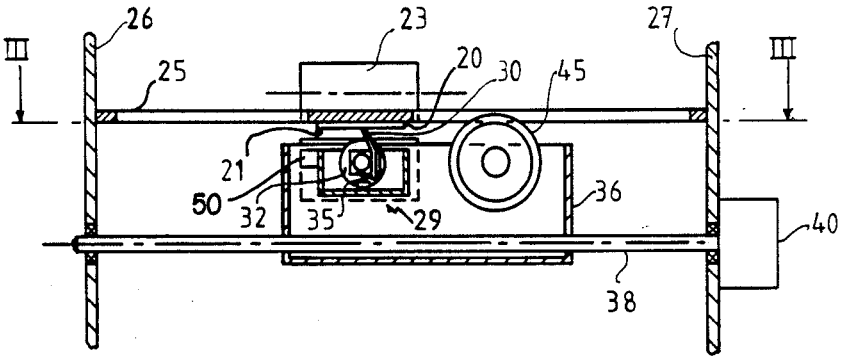
FIG. 2 is a cross-section of one embodiment of a device for partial removal of the layer of glue from the binder material as used in the apparatus according to the invention.
Figure 3:
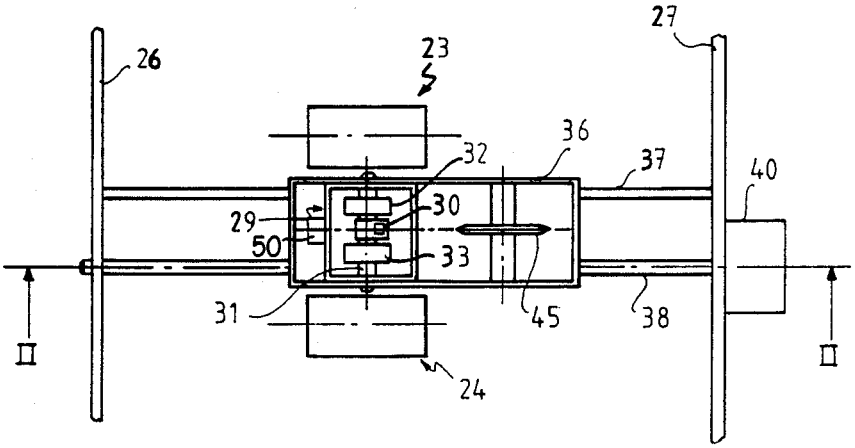
FIG. 3 is a cross-section taken along line III—III of FIG. 2.

FIGS. 2 and 3 illustrate in detail the embodiment of removal station 3 in which the layer of glue around the cutting line is largely scared off.

The binder material consisting of a support 20 and a layer of glue 21 is tensioned in removal station 3 by pairs of rollers 23 and 24 to hold i& taut against a support plate 25 fixed between frame plates 26 and 27 of the binder apparatus. The scraper device 29 consists of a scraper element 30 slidably fixed in a spindle 31, on which guide wheels 32 and 33 are mounted to be freely rotatable on either side of the scraper element 30. Scraper element 30 is displacably fixed on spindle 31 to enable the scraping thickness of the scraper device 29 to be adjusted. Scraper element 30 is provided with a chisel-shaped tip which, as known from machining technique, can be constructed with a relief angle in order to improve the scraping effect.

The scraper element 30 and guide wheels 32 and 33 are pressed against the binder material by compression springs 35, for example. which engage the ends of spindle 31. If required, a known adjusting device can be used to enable the contact-pressure force to be adjusted to the required level.

The movement of scraper element 30 perpendicularly to the strip of binder material as required to remove glue largely from a strip zone of a width of a few millimeters is obtained by securing the complete scraper device 29 in carriage 36. Carriage 36 is, on the one hand, mounted for displacement on a guide rod 37 disposed between frame plates 26 and 27 and, on the other hand, mounted on a screw spindle 38 via nuts (not shown) secured in carriage 36.

Screw spindle 38 is rotated by drive motor 40 so that carriage 36 with the scraper device 29 thereon is displaced transversely of the binder material. Movement of carriage 36 in the reverse direction is also possible since the direction of rotation of motor 40 is reversible.

Of course this embodiment of the movement mechanism for the scraper device 29 can be replaced by other movement mechanism.

Removal of the heat activated .layer of glue can also be considerably simplified by softening the layer of glue by means of heat. This can be done by heating scraper element 30 or part of the binder material at the scraper device. This heating can be effected by an infrared radiator element 50, contact with a heated body, or with another known heat source.

Since as described above the strip of binder material is positioned in the processing position in order to prosecute the scraping process, it is advantageous to carry out the subsequent cutting operation without displacing and subsequent positioning of the strip of binder material.

The cutting operation can, for example, be combined with the scraping operation by disposing a cutter knife 45 on carriage 36 after scraper device 29 as considered in the direction of movement, said knife 45 being rotated by a drive not shown. When scraper device 29 has removed glue from a strip zone, knife 45 cuts the strip of binder material off centrally in the zone to the length determined by the detection means.

Of course the invention is not restricted to this embodiment. Instead, a separate cutter device can be provided, e.g., rotating transverse knives or guillotine knives. The invention may be otherwise embodied within the scope of the appended claims.

What is claimed is:

1. In apparatus for binding a stack of sheets along one peripheral side by means of a strip of binder material having a heat activated layer of glue, comprising a supply station for a web of binder material, a binder station, conveyor means for conveying said binder material from said supply station to said binder station, and a cutting device for cutting off a strip of binder material of the required length, the improvement in combination therewith comprising a selectively activated removal means for at least partially removing a layer of glue in a zone over the complete width of said binder material, and control means for temporarily activating said removal means with an interval related to the required length of said strip of binder material.

2. Apparatus according to claim 1, wherein said means for at least partially removing said layer of glue comprises a scraper.

3. Apparatus according to claim 2, including a heating device for heating said scraper.

4. Apparatus according to claim 2 or 3, including a heating device by which said binder material can be heated in the vicinity of said scraper.

5. Apparatus according to claims 1, 2 or 3, wherein said removal means are disposed in line with said cutting device transversely of the direction of conveyance of the binder material so that the line along which said binder material is cut falls within the zone in which said layer of glue is at least partially removed.

* * * * *